US007937018B2

(12) United States Patent
Murakami et al.

(10) Patent No.: US 7,937,018 B2
(45) Date of Patent: May 3, 2011

(54) DEVELOPER SUPPLY CONTAINER

(75) Inventors: Katsuya Murakami, Toride (JP); Ayatomo Okino, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 568 days.

(21) Appl. No.: 11/555,399

(22) Filed: Nov. 1, 2006

(65) Prior Publication Data

US 2007/0104505 A1 May 10, 2007

(30) Foreign Application Priority Data

Nov. 8, 2005 (JP) ..... 2005-323691

(51) Int. Cl.
*G03G 15/00* (2006.01)

(52) U.S. Cl. ..... 399/106

(58) Field of Classification Search ..... 399/106, 399/119

See application file for complete search history.

(56) References Cited

U.S. PATENT DOCUMENTS

| | | | | |
|---|---|---|---|---|
| 5,036,341 | A | 7/1991 | Larsson | |
| 5,671,461 | A | 9/1997 | Ishii | |
| 5,822,653 | A | 10/1998 | Ishii | 399/104 |
| 5,909,606 | A * | 6/1999 | Fujiwara | 399/106 |
| 6,324,371 | B1 | 11/2001 | Okiyama et al. | 399/262 |
| 6,879,789 | B2 | 4/2005 | Yamada et al. | |
| 6,920,298 | B2 | 7/2005 | Yamada et al. | |
| 6,990,301 | B2 | 1/2006 | Yamada et al. | |
| 7,127,193 | B2 | 10/2006 | Yamada et al. | |
| 2004/0208668 | A1 | 10/2004 | Kurihara et al. | |
| 2005/0047818 | A1 | 3/2005 | Yamada et al. | |
| 2005/0135841 | A1 | 6/2005 | Murakami et al. | |
| 2005/0271426 | A1 | 12/2005 | Okino et al. | |
| 2006/0008290 | A1 | 1/2006 | Yamada et al. | |
| 2006/0008291 | A1 | 1/2006 | Yamada et al. | |
| 2006/0104671 | A1 | 5/2006 | Murakami et al. | |
| 2007/0086810 | A1 | 4/2007 | Yamada et al. | |
| 2007/0092304 | A1 | 4/2007 | Yamada et al. | |
| 2007/0098454 | A1 | 5/2007 | Yamada et al. | |
| 2007/0134021 | A1 | 6/2007 | Yamada et al. | |

FOREIGN PATENT DOCUMENTS

| | | | |
|---|---|---|---|
| JP | 60-147767 | | 8/1985 |
| JP | 8-171271 | A | 7/1996 |
| JP | 10-48938 | | 2/1998 |
| JP | 2001005273 | A * | 1/2001 |
| JP | 2001-42620 | A | 2/2001 |
| JP | 2003-156927 | | 5/2003 |
| JP | 2004-085815 | | 3/2004 |
| JP | 2005-274862 | | 10/2005 |

(Continued)

OTHER PUBLICATIONS

Office Action, dated Dec. 17, 2007, issued in Korean counterpart Application No. 10-2006-0109193.

(Continued)

*Primary Examiner* — David M Gray
*Assistant Examiner* — Erika Villaluna
(74) *Attorney, Agent, or Firm* — Fitzpatrick, Cella, Harper & Scinto

(57) ABSTRACT

A developer supply container detachably mountable to a developer receiving apparatus, the developer supply container includes an containing portion for containing a developer; a discharge opening, provided in the containing portion, for permitting discharge of the developer; a shutter for opening and closing the discharge opening; an elastic member, provided around the discharge opening, for sealing between the developer supply container and the developer receiving apparatus; and a film member for unsealably sealing the discharge opening.

10 Claims, 6 Drawing Sheets

FOREIGN PATENT DOCUMENTS

| | | |
|---|---|---|
| KR | 2002-0004545 | 1/2002 |
| RU | 2 057 028 C1 | 3/1996 |

OTHER PUBLICATIONS

Office Action, dated Dec. 26, 2007, issued in Russian counterpart Application No. 2006129125/28.

Office Action, dated May 23, 2008, issued in Chinese counterpart Patent Application No. 200610143966.6 and English-language translation thereof.

Russian Decision, dated Jul. 31, 2008, issued in Russian counterpart Patent Application No. 2006139125/28 and an English-language translation thereof.

Japanese Office Action, dated Jan. 20, 2009, issued in Japanese counterpart Patent Application No. 2006-262851.

Japanese Office Action, dated Apr. 21, 2009, issued in Japanese counterpart Patent Application No. 2006-262851.

* cited by examiner

DEVELOPER SUPPLY CONTAINER

FIELD OF THE INVENTION AND RELATED ART

The present invention relates to a developer supply container which is removably mountable in a developer receiving apparatus. As an example of a developer receiving apparatus, an image forming apparatus, such as a copying machine, a facsimile machine, a printer, or the like, which forms an image with the use of an electrophotographic method, an electrostatic recording method, or the like, may be listed.

Particulate toner has long been used as the developer for an image forming apparatus, such as an electrophotographic copying machine or a printer. It has been a common practice to supply an image forming apparatus with toner from a toner supply container, as the toner in an image forming apparatus is consumed.

As the methods for supplying an image forming apparatus with the use of a toner supply container such as the above-described one, various methods have been proposed which leave a toner supply container in the main assembly of an image forming apparatus and gradually supply the main assembly with the toner from the toner supply container. Some of these methods have been put to practical use. These toner supply containers, and the image forming apparatuses usable with these toner supply container, are designed to prevent toner from scattering in the image forming apparatuses when the image forming apparatuses are supplied with toner.

For example, the toner supply container disclosed in Japanese Laid-open Patent Application 10-48938 is provided with an elastic seal, which is attached to the toner supply container in a manner to surround the opening of its toner outlet to prevent the toner from the toner supply container, from entering the gaps between the toner supply container and an image forming apparatus, while the apparatus is supplied with the toner from the toner supply container. A toner supply container, such as the above mentioned one, is provided with a shutter for exposing or covering the opening of its toner outlet.

The toner supply container recorded in the Japanese Laid-open Patent Application 10-48938 is provided with a shutter for exposing or covering the opening of its toner outlet to prevent toner from leaking during its distribution.

In the case of the above-described structural arrangements, however, the elastic seal is kept highly compressed between the toner supply container and shutter. Therefore, the frictional resistance between the shutter and elastic seal is very large, making substantial the amount of force necessary to open or close the toner supply container, which possibly reduces an image forming apparatus in operability.

SUMMARY OF THE INVENTION

The primary object of the present invention is to provide a developer supply container which is substantially smaller in the amount of force necessary to open or close its shutter than a developer supply container in accordance with the prior art, and does not leak toner during the distribution of the developer supply container.

Another object of the present invention is to provide a developer supply container provided with a sealing film which prevents toner from leaking, while preventing the elastic member of the developer container from deteriorating, during the distribution of the developer supply container.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 2,(*b*) is a cross-sectional view of the toner supply container, as seen from the direction indicated by an arrow mark A in FIG. 2,(*a*); and FIG. 2,(*c*) is an enlarged perspective view of the portion of the toner supply container, which is surrounded by the circle designated by a referential character B in FIG. 2,(*a*).

FIG. 3,(*b*) is a perspective view of the toner supply container bay of the toner receiving apparatus, the toner receiving opening of which is closed; and FIG. 3,(*c*) is a perspective view of the toner supply container bay of the toner receiving apparatus, the toner receiving opening of which is open.

DETAILED DESCRIPTION OF THE PREFERRED EMBODIMENTS

Hereafter, the preferred embodiments of the present invention will be described in detail with reference to the appended drawings. Incidentally, the measurements, materials, shapes of the structural components described in the following embodiments of the present invention, and the positional relationship among the structural components, are not intended to limit the scope of the present invention, unless specifically noted. That is, the preferred embodiments are modifiable, as fits, according to the structure of an apparatus to which the present invention is applied, and the various conditions under which the apparatus to which the present invention is applied is operated.

Embodiment 1

<Image Forming Apparatus>

First, referring to FIG. 1, an electrophotographic copying machine, as an example of an electrophotographic image forming apparatus, which is a developer receiving apparatus in which a toner supply container, as a developer supply container, is mounted, will be described regarding its structure.

Figure 1:
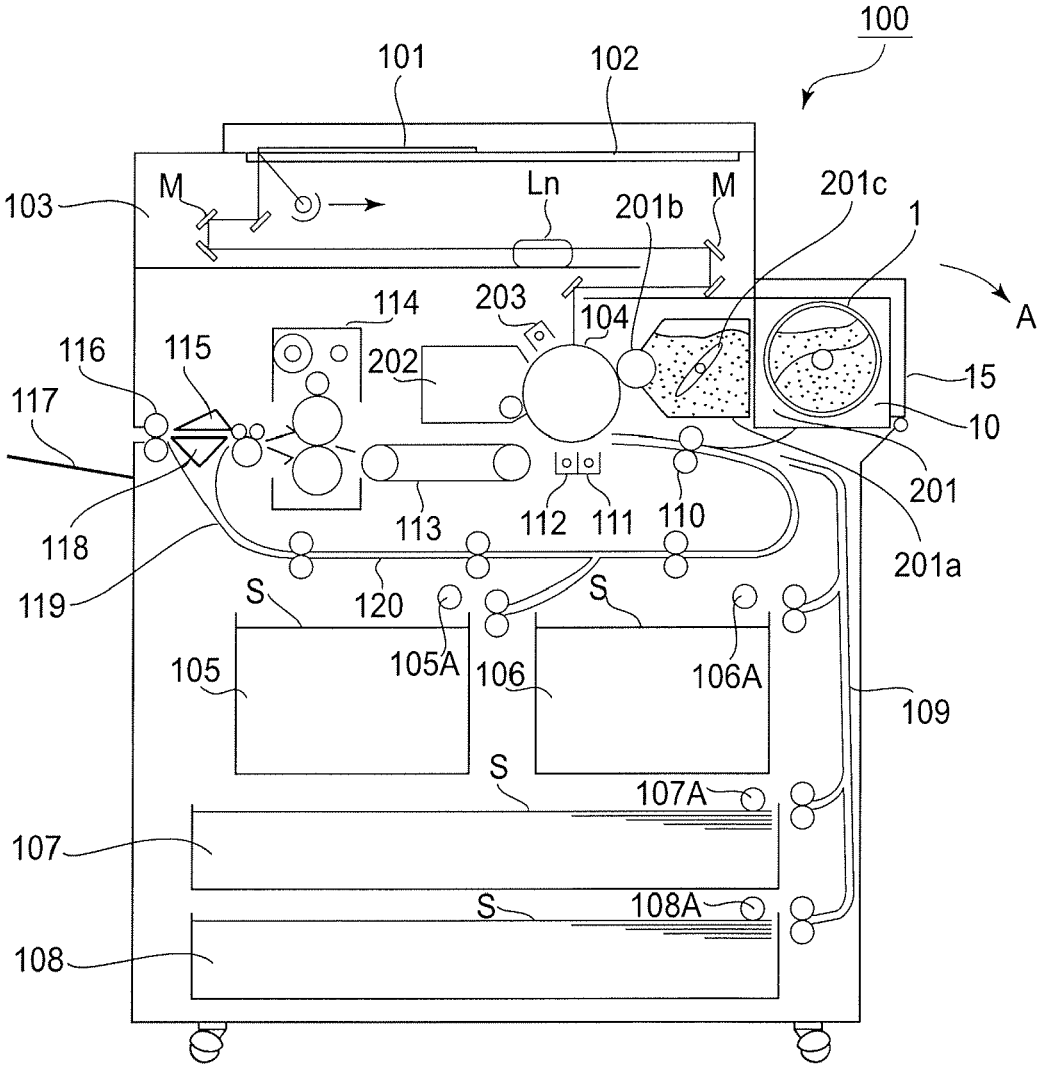
FIG. 1 is a schematic sectional view of an electrophotographic copying machine, as an example of an electrophotographic image forming apparatus in accordance with the present invention, in which a toner supply container in accordance with the present invention is mountable, showing the general structure thereof.

In FIG. 1, designated by a referential numeral 100 is a main assembly of the electrophotographic copying machine (which hereafter will be referred to as apparatus main assembly). Designated by a referential numeral 101 is an original, which is placed on an original placement glass platen 102. An optical image in accordance with the picture information is focused on an electrophotographic photosensitive drum 104 by the multiple mirrors and a lens Ln of an optical portion 103.

Designated by referential numerals 105-108 are cassettes in which sheets P of recording medium (which hereafter may be referred to as recording paper P) are stored. Among the recording mediums P stored in layers in these cassettes 105-108, the optimal recording medium P is selected based on the information inputted by a user through the control panel of the apparatus main assembly, the size of the original 101, and the information regarding the size of the recording medium P stored in each of the cassettes 105-108. The choice of the recording medium P is not limited to recording paper. For example, the apparatus can be used with an OHP sheet or the like. In other words, the choice of recording medium is optional.

Each of the sheets of recording paper P conveyed by feeding-and-separating apparatuses 105A-108A is conveyed to a pair of registration rollers 110 by way of a conveyance path 109. Then, the pair of registration rollers 110 releases forward the sheet of recording paper P in synchronization with the rotation of the photosensitive drum 104 and the scanning timing of the optical portion 103.

Designated by referential numerals 111 and 112 are a transfer discharger and a separation discharger, respectively. The transfer discharger 111 is a discharger for electrostatically transferring a toner image formed on the peripheral surface of the photosensitive drum 104, onto the sheet of recording paper P. The separation discharger 112 is a discharger for removing the electric charge from the sheet of recording medium P when separating the sheet of recording paper P from the photosensitive drum 104 after the transfer of the toner image onto the sheet of recording paper P.

After being separated from the photosensitive drum 104, the sheet of recording paper P is conveyed by a conveying portion 113 to a fixation station 114. In the fixation station 114, the sheet of recording paper P and the unfixed toner image thereon are subjected to heat and pressure. As a result, the unfixed image is fixed to the surface of the sheet of recording medium P. Then, when the copying machine is in the single-sided copying mode, the sheet of recording paper P is discharged by a pair of discharge rollers 116 into a delivery tray 117. However, when the copying machine is in the two-sided copying mode, the flapper 118 of a discharging-or-reversing station 115 is controlled so that the sheet of recording paper P is conveyed to the pair of registration rollers 110 by way of refeeding-and-conveying portions 119 and 120. Then, the sheet of recording paper P is conveyed through the same route as that through which the sheet of recording paper P is conveyed when the copying machine is in the single-sided copying mode, and is discharged into the delivery tray 117.

When the copying machine is in the multilayer copying mode, the sheet of recording paper P is conveyed outward through the discharging-or-reversing station 115 by the pair of discharge rollers 116, by a distance large enough for the sheet of recording paper P to be partially exposed from the apparatus main assembly, that is, until the trailing edge of the sheet of recording paper P reaches the area between the flapper 118 and pair of discharge rollers 116. Then, while the sheet of recording paper P remains pinched between the pair of discharge rollers 116, the flapper 118 is controlled and the discharge rollers 116 are rotated in reverse. As a result, the sheet of recording paper P is conveyed back into the apparatus main assembly. Then, the sheet of recording paper P is conveyed to the pair of registration rollers 110 by way of the refeeding-and-conveying portions 119 and 120. Then, it is conveyed through the same route as that through which the sheet of recording paper P is conveyed when the copying machine is in the single-sided copying mode, and is discharged into the delivery tray 117.

Regarding back to the apparatus main assembly 100 structured as described above, in the adjacencies of the peripheral surface of the photosensitive drum 104, a development station 201, a cleaning station 202, a primary charger 203, etc., are disposed.

The development station 201 is a station which develops an electrostatic latent image formed on the peripheral surface of the photosensitive drum 104 by the optical portion 103, based on the information regarding the original 101, with the use of toner as developer. The apparatus main assembly 100 is holding a toner supply container 1 for supplying toner to the development station 201. The toner supply container 1 is removably mountable in the apparatus main assembly 100 by a user.

The development station 201 has a toner receiving apparatus 7 in which the toner supply container 1 is removably mountable, and a developing device 201*a*. The developing device 201*a* has a development roller 201*b* and a developer sending member 201*c*. Toner is supplied from the toner supply container 1 into the developing device 201*a*. Then, the toner is sent by the toner sending member 201*c* to the development roller 201*b*, by which the toner is supplied to the electrostatic latent image formed on the peripheral surface of the photosensitive drum 104.

The cleaner 202 is a device for removing the toner remaining on the peripheral surface of the photosensitive drum 104. The primary charger 203 is a device for charging the photosensitive drum 104.

The apparatus main assembly 100 is provided with a toner supply container bay cover 15, which also functions as a part of the external cover of the apparatus main assembly. When a user wants to replace the toner supply container 1, the user is to open the toner supply container bay cover 15 in the direction indicated by an arrow mark A.

<Toner Supply Container>

Next, referring to FIGS. 2(*a*)-2(*c*), the toner supply container 1, as a developer supply container, will be described regarding its structure.

The container proper 1*a* of the toner supply container 1, which is the actual storage portion of the toner supply container 1, is roughly in the form of a hollow cylinder. The cylindrical portion of the container proper 1*a* is provided with an opening 1*b*, as a toner outlet, which is roughly in the form of a long and narrow rectangle, the long edges of which are parallel to the lengthwise direction of the container 1.

When the toner supply container 1 has never been used, the opening 1*b* is airtightly sealed with a seal 9 formed of film (which hereafter will be referred to as sealing film 9). The sealing film 9 is longer than twice the length of the opening 1*b*; the sealing film 9 is welded to the container proper 1*a*, from one end of the opening to the other, in terms of the lengthwise direction of the toner supply container 1, in a manner to seal the opening 1*b*, is folded back to the starting end, and is extended beyond the starting end. The sealing film 9 is to be peeled away by a user after the mounting of the toner supply container 1 into the toner receiving apparatus 7, which will be described later; as the user pulls the sealing film 9 by grasping the portion of the sealing film 9, which is extending outward beyond the aforementioned starting end of the sealing film 9, the opening 1*b* is exposed.

Incidentally, the sealing film 9 in this embodiment is designed so that it is to be peeled away from the container proper 1*a* to expose the opening 1*b*. However, the sealing film 9 may be designed as follows.

For example, the sealing film 9 may be provided with a pair of tear guides (tear lines) so that as the sealing film 9 is pulled, it easily tears along the pair of tear guides. These tear guides can be formed by thinning the sealing film 9 along preset lines on the sealing film 9 by exposing the portions of the sealing film 9, which correspond to the preset lines, to a beam of laser light. The method for thinning the sealing film 9 along the preset lines may be a method other than the above mentioned laser-based one.

The sealing film 9 is provided to prevent toner from leaking from a developer supply container while the developer supply container is distributed. More specifically, the sealing film 9 is provided to prevent toner from leaking from a developer supply container, when a certain amount of changes occurs to the ambience of the developer supply container (changes in temperature, humidity, and atmospheric pressure), during the distribution of the developer supply container. Moreover, the sealing film 9 prevents the toner from leaking from the developer supply container due to the vibrations of the developer supply container, which occur during the distribution of the developer supply container, and/or due to the impacts which might occur if the developer supply container happens to fall during its distribution.

However, even if the container proper is sealed with the sealing film 9, the toner leak occurs sometimes, for example, if the changes in the ambience of the developer supply container, which occur during the distribution of the developer supply container, are rather large, and/or the impacts which result from the falling of the developer supply container during the distribution of the developer supply container are severe.

Thus, the role of the sealing film 9 in this embodiment is to prevent the toner leak, within a reasonable range of changes in the ambience of a developer supply container which the developer supply container might encounter during its distribution. In other words, in the following description of the preferred embodiments of the present invention, prevent toner leak means to prevent the toner leak, within the reasonable range of the changes in the ambience of the developer supply container, which the developer supply container might encounter during the distribution of the developer supply container.

As the method for attaching the sealing film 9 to the container proper 12, the welding method which uses a heated plate, impulse, ultrasonic waves, or, high frequency waves, the bonding method which uses ordinary adhesive or hot-melt adhesive, the method which uses two-sided adhesive tape, or the like can be used. In this embodiment, the method which uses a heated plate is employed.

The toner supply container 1 is provided with a sealing member 10, which is an elastic member 10 (elastic seal) attached to the container proper la in a manner to surround the opening 1*b*. The sealing member 10 is provided to practically completely prevent the toner from entering the gap between the toner supply container 1 and toner receiving apparatus 7, when the toner is supplied from the toner supply container 1 into the toner receiving apparatus 7. More specifically, the sealing member 10 is remains compressed by a preset amount between the container proper 1*a* and container shutter. Thus, it prevents the toner from entering the above mentioned gap, by playing the role of bridging the gap between the toner supply container 1 and toner receiving apparatus 7. Incidentally, here, toner entry is prevented means not only the case that the toner entry is perfectly prevented, but also, the case that toner enters the above mentioned gap by an amount which is practically too small to cause a problem.

Parenthetically, the sealing member 10 is a member which plays its role after the peeling of the sealing film 9. In order to optimally fill the gap between the toner supply container and toner receiving apparatus 7, it is desired to be along the edge of the opening 1*b* that the sealing member 10 is attached to the container proper 1*a*.

Figure 2:
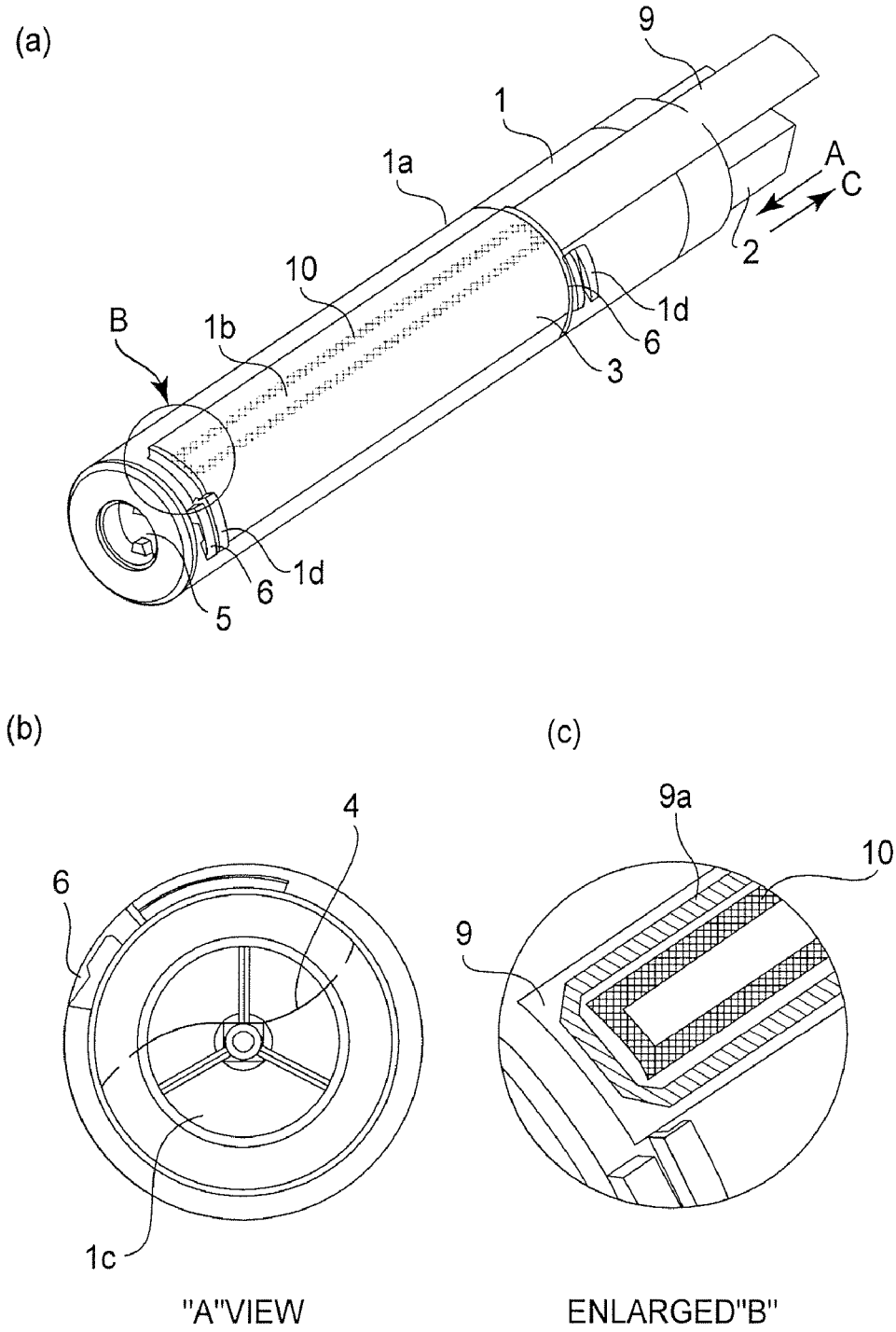
FIG. 2,(*a*), is a perspective view of the toner supply container in accordance with the present invention.

Therefore, it is desired that before the sealing member 9 is attached to the container proper 1*a*, the sealing member 10 is fixed to the container proper 1*a*, and then, the sealing film 9 is attached to the container proper 1*a* in a manner to cover the sealing member 10 as well as its adjacencies, as shown in FIG. 2(*c*).

Thus, in this embodiment, the portion 9*a* of the sealing film 9, by which the sealing film 9 is welded to the container proper l*a*, is patterned so that as the sealing member 9 is welded to the container proper 1*a*, the portion 9*a* of the sealing film 9 surrounds the sealing member 10. The employment of the above mentioned structural arrangement can prevent the sealing member 10 from being damaged when the sealing film 9 is peeled off. That is, it can prevent the sealing member 10 from being reduced in its performance of keeping sealed the aforementioned gap when toner is supplied from the toner supply container 1 to the toner receiving apparatus 7. Further, the sealing film 9 is also given the function of protecting the surface of the sealing member 10. That is, in the case of the above described structural arrangement in this embodiment, the sealing film 9 can prevent the sealing member 10 from deteriorating until the toner supply container 1 is used for the first time to supply the toner receiving apparatus 7 with toner.

In consideration of the frictional pressure between the sealing member 10 and the wall of the toner receiving apparatus 7, the material for the sealing member 10 is desired to be low in density. More specifically, a foamed substance such as high density polyurethane foam, woven or unwoven fabric based on animal fiber such as wool or silk, plant fiber such as cotton or linen, or synthetic fiber such as Nylon, polyester, acrylic, may be listed. From the standpoint of compressibility, it is desired to use a foamed substance as the material for the sealing member 10. In this embodiment, high density polyurethane foam is used as the material for the sealing member 50.

Referring to FIG. 2(*a*), the toner supply container 1 is provided with a container shutter 3, the curvature of which matches that of the peripheral surface of the container proper la of the toner supply container 1, and which is attached to the toner supply container 1 so that it can cover the opening 1*b*. Prior to the removal of the sealing film 9, the sealing film 9 remains covered by the container shutter 3. This container shutter 3 is engaged with a pair of guiding members 1*d*, which are disposed at the lengthwise ends of the container proper 1*a*, one for one. The toner supply container 1 is structured so that the container shutter 3 can be slid in the circumferential direction of the container proper 1*a*, following the peripheral surface of the container proper 1*a*.

In terms of the lengthwise direction of the container proper 1*a*, one of the end walls of the container proper 1*a* is provided with an opening 1*c* as a toner inlet, which is sealed with an unshown cap or the like after the toner supply container 1 is filled with toner.

Further, the toner supply container 1 is provided with a handle 2, as a hand grip, which is for a user to grasp when mounting or dismounting the toner supply container 1. The handle 2 is attached to one of the lengthwise ends of the toner supply container 1. The shape of the handle 2 does not need to be limited to that in this embodiment. That is, any shape is acceptable as long as it makes the handle 2 usable for mounting or dismounting the toner supply container 1, and also, sufficiently useful for rotating the toner supply container 1.

The container proper 1*a* is provided with a conveying member 4, which is disposed within the hollow of the container proper 1*a*. This conveying member 4 is made up of a rotational shaft and stirring blades. The axial line of the rotational shaft coincides with that of the coupling which will be described later. The stirring blades are attached to the rotational shaft. The stirring blades have the function of conveying the toner in the container proper 1*a* toward the opening 1*b*, and also, the function of stirring the toner.

Further, the toner supply container 1 is provided with a coupling 5, which is located at the opposite lengthwise end of the container proper 1*a* from where the handle 2 is located. The coupling 5 is connected to the conveying member 4 so that as the coupling 5 is rotated, the conveying member 4 is rotated by the rotation of the coupling 5. In this embodiment, the rotational shaft of the conveying member 4 and coupling 5 are integrally molded of resin.

The coupling 5 is enabled to engage with the coupling mechanism of the apparatus main assembly 100. The apparatus main assembly and toner supply container 1 are structured so that the coupling 5 receives rotational driving force when toner can be discharged from the toner supply container 1 set in the image forming apparatus main assembly.

As rotational driving force is transmitted to the conveying member 4 through coupling 5, the conveying member 4 rotates relative to the toner supply container 1 which is practically nonrotatively anchored to the apparatus main assembly. As a result, the toner in the toner supply container 1 is conveyed, while being stirred, by the conveying member 4 toward the opening 1*b*, and then, is discharged through the opening 1*b*.

Incidentally, the toner supply container 1 does not need to be immovably anchored to the apparatus main assembly. That is, it does not matter as long as the apparatus main assembly and toner supply container 1 are structured so that the toner supply container 1 is prevented by the apparatus main assembly, at least from being rotated by the rotation of the conveying member 4 in the same direction as the rotational direction of the conveying member 4.

<Toner Receiving Apparatus>

Next, referring to FIGS. 3(*a*)-3(*c*), the toner receiving apparatus 7, as the developer receiving apparatus on the image forming apparatus main assembly side, will be described regarding its structure.

The toner receiving apparatus 7 is provided with a bay 7*a* (storage space) in which the toner supply container 1 is removably mounted, and a toner receiving opening 7*b*, through which the toner discharged from the toner supply container 1 is received into the image forming apparatus main assembly.

The toner receiving apparatus 7 is also provided with an apparatus shutter 8, which can repeatedly seal or unseal the toner receiving opening 7*b*. The curvature of the apparatus shutter 8 matches the curvature of the peripheral surface of the toner supply container 1 and the curvature of the wall of the toner supply container bay 7*a*. It is connected to a guiding member (unshown) located at the bottom edge of the toner supply container bay 7*a*. The employment of the above described structural arrangement makes it possible for the apparatus shutter 8 to be slid in the circumferential direction of the toner supply container bay 7*a* to expose or cover the toner receiving opening 7*b* (FIG. 3(*b*)-FIG. 3(*c*)).

Figure 3:
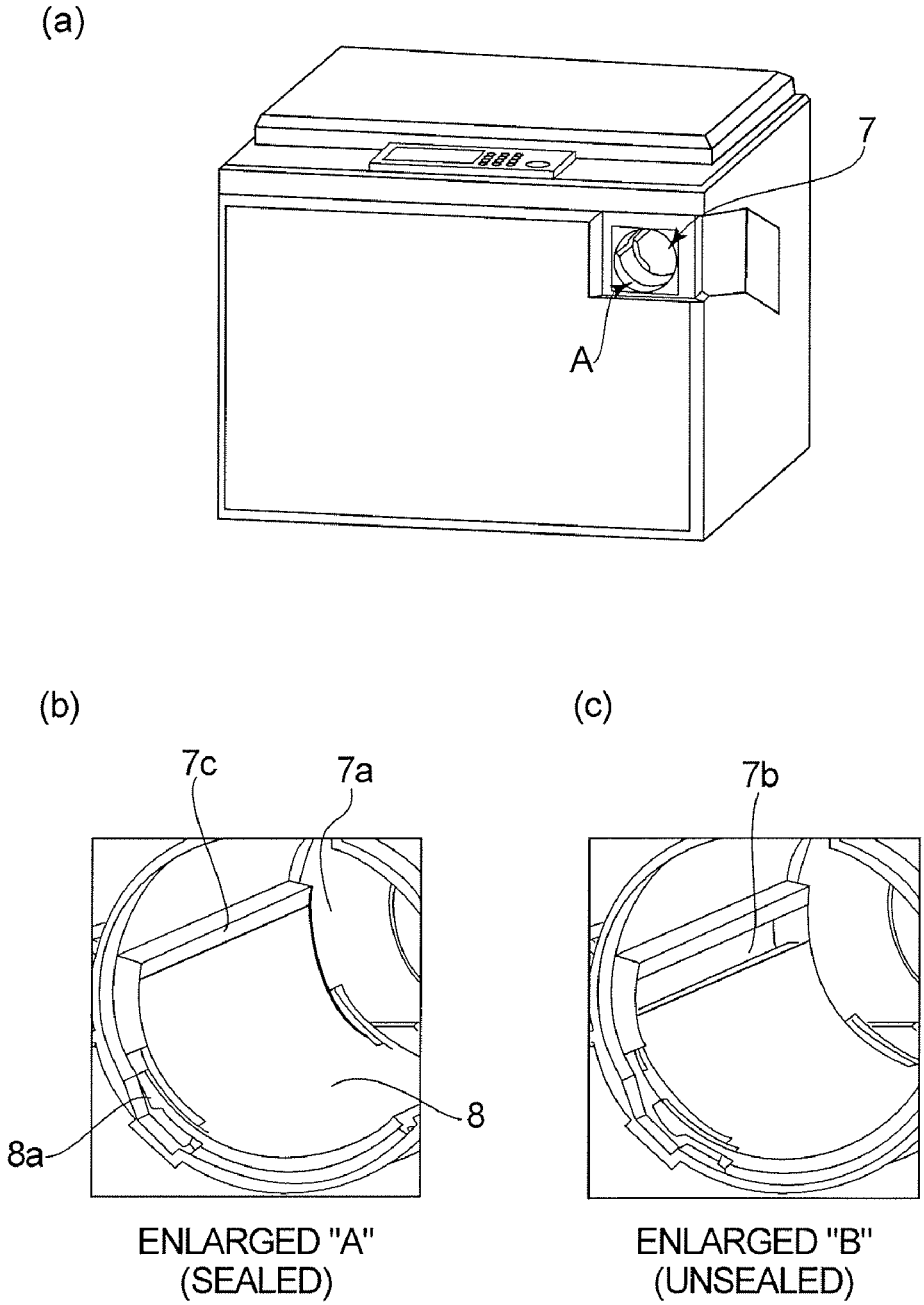
FIG. 3,(*a*) is an external perspective view of the toner receiving apparatus in accordance with the present invention.

Referring to FIG. 3(*b*), when the toner supply container 1 is not in the toner supply container bay 7*a*, the adjacency of the edge (top edge in FIG. 3(*b*)) of this apparatus shutter 8 is in contact with the a stopper 7*c* with which the toner receiving apparatus 7 is provided, being thereby prevented from rotating beyond the stopper 7*c*. That is, the toner receiving opening 7*b* remains closed by the apparatus shutter 8, preventing toner from flowing back from the image forming apparatus main assembly side to the toner supply container bay 7*a* side.

Next, referring to FIGS. 3(*b*) and 3(*c*), the apparatus shutter 8 is also provided with a connective portion 8*a*, which connects with the connective portion 6 of the toner supply container 1.

As for the connection of the connective portion 6 of the toner supply container 1 to the connective portion 8*a* of the apparatus shutter 8, the rotation of the toner supply container 1 (in terms of circumferential direction of toner supply container 1) from the position in the toner receiving apparatus 7, into or from which the toner supply container 1 is mounted or dismounted, respectively, to the toner supplying position into which the toner supply container 1 is rotated by a preset angle, connects the connective portion 6 of the toner supply container 1 to the connective portion 8*a* of the apparatus shutter 8.

<Operation for Setting up or Extracting Toner Supply Container>

Figure 4:
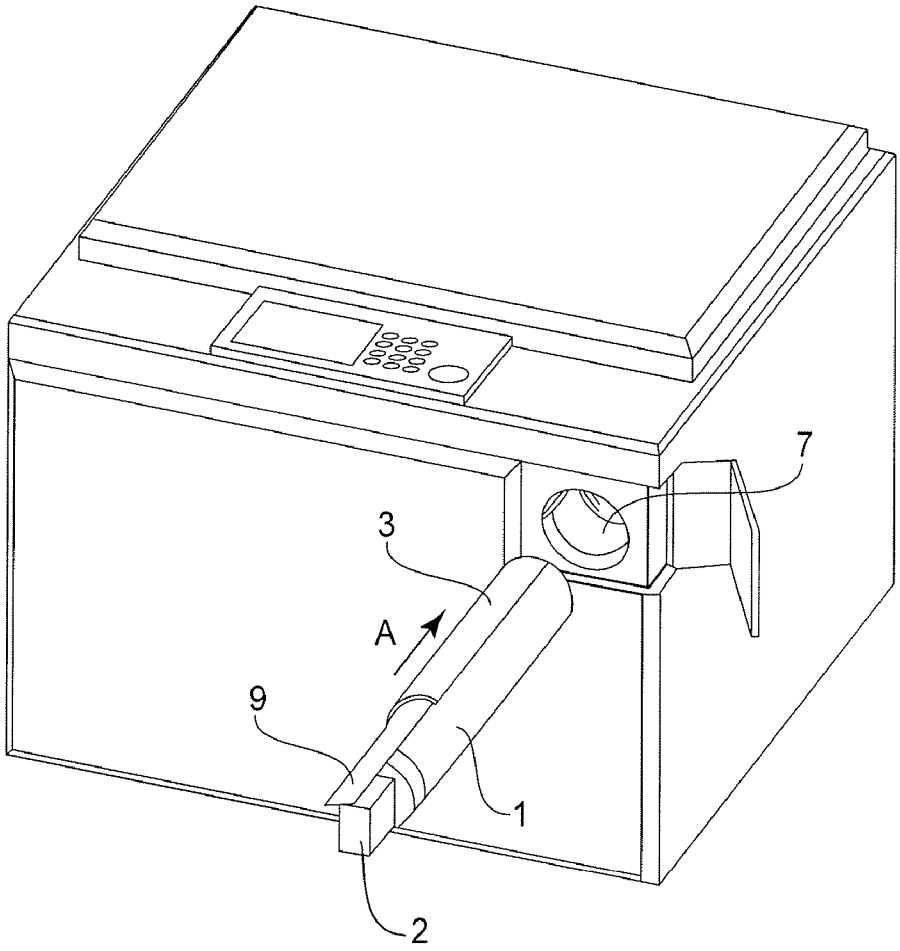
FIG. 4 is a perspective view of the toner receiving apparatus and toner supply container, in accordance with the present invention, showing how the latter is mounted into the former.

Next, referring to FIGS. 4, and 5(*a*)-5(*d*), the operation for setting up the toner supply container 1 in the apparatus main assembly or extracting it from the apparatus main assembly will be described. The FIG. 5(*b*) and 5(*d*) are enlarged views of the adjacencies of the openings 1*b* shown in FIGS. 5(*a*) and FIG. 5(*c*), respectively.

First, a user is to grasp the handle 2 and insert the toner supply container 1 into the toner receiving apparatus 7. More concretely, the toner supply container 1 is to be mounted into the toner receiving apparatus 7 from the direction indicated by an arrow mark A (FIG. 4).

Figure 5:
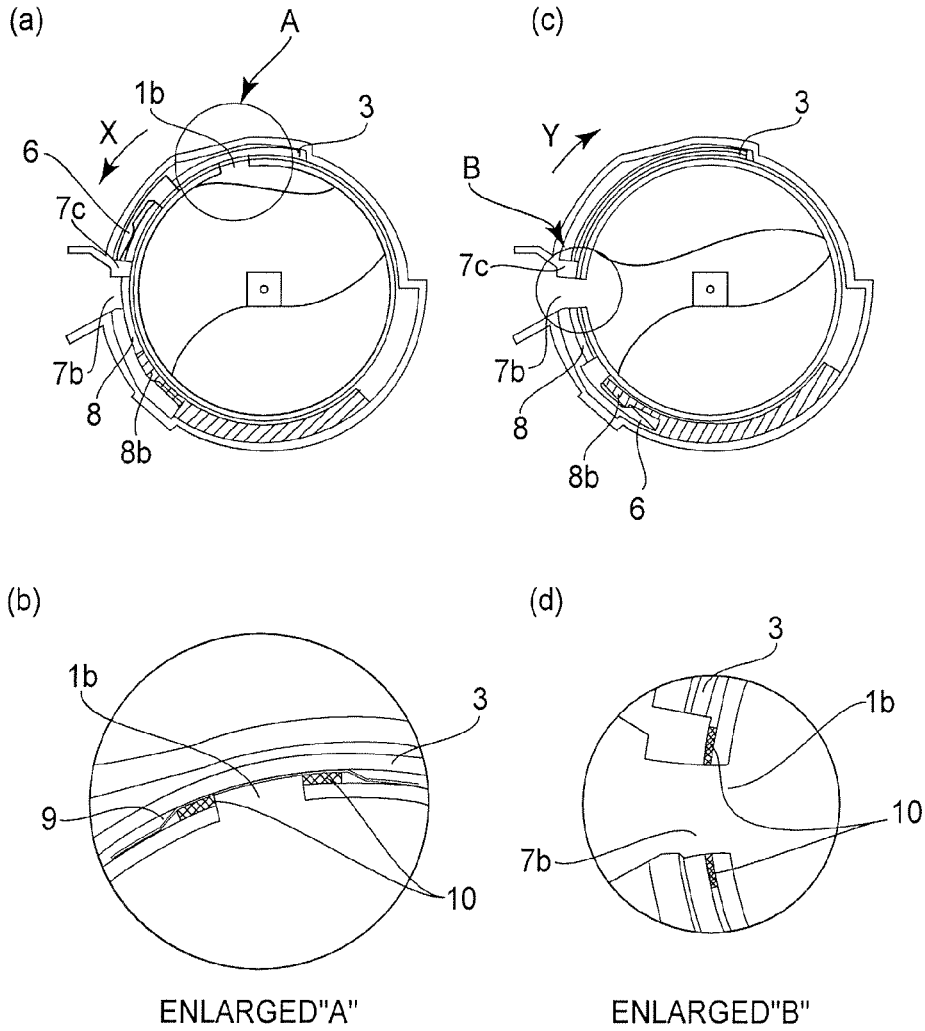
FIG. 5 is cross-sectional views of the toner supply container in accordance with the present invention, showing the operation for discharging toner, wherein (a) illustrates the toner supply container immediately after the mounting of the container, (b) is an enlarged view of a portion A indicated in (a), (c) illustrates the toner supply container during discharging of the toner, and (d) is an enlarged view of a portion B in indicated in (c).

During the mounting of the toner supply container 1 into the toner receiving apparatus 7, the opening 1*b* of the toner supply container 1 is facing upward, remaining sealed with the sealing film 9, and the shutter 3 is in the closed position (FIG. 5(*b*)).

That is, the opening 1*b* of the toner supply container 1 is in the position, which is apart from the toner receiving opening 7*b* remaining sealed with the apparatus shutter 8, in terms of the rotational direction of the toner supply container 1. Further, the connective portion 6 of the toner supply container 1 is also in the position, which is apart from the connective portion 8*a* of the shutter 8, in terms of the rotational direction of the toner supply container 1 (FIG. 5(*a*)).

Next, the user is to pull the outwardly extending end portion of the sealing film 9 in the direction indicated by an arrow mark C (FIG. 2(*a*)), to peel the sealing film 9.

Then, the user is to grasp the handle 2 and rotate the toner supply container 1 in the counterclockwise direction (X direction in FIG. 5(*a*)), as seen from the direction of the opening 1*c* as the toner inlet.

Incidentally, the toner supply container 1 and apparatus main assembly are structured so that when the toner supply container 1 is rotated, the rotation of the container shutter 3 in the circumferential direction of the toner supply container 1 is regulated by the stopper 7*c*.

That is, during the initial stage of the rotation of the toner supply container 1 in the direction X, the container shutter 3 moves with the toner supply container 1. However, as the toner supply container 1 is further rotated in the direction X, the container shutter 3 comes into contact with the above described stopper 7*c*, being therefore prevented from rotating further.

Then, as the toner supply container 1 is further rotated in the same direction, the connective portion 6 of the toner supply container 1 engages with the connective portion 8*a* of the apparatus shutter 8. Then, as the toner supply container 1 is further rotated, the apparatus shutter 8 is pushed by the connective portion 6, being thereby forced to rotate with the toner supply container 1. As a result, the toner receiving opening 7*b* is exposed; the toner receiving opening 7*b* becomes connected to the opening 1*b* (FIG. 5(*c*) and 5(*d*)).

The toner supply container 1 and apparatus main assembly are structured so that only when the toner receiving opening 7*b* is in connection with the opening 1*b*, the coupling 5 of the toner supply container 1 receives driving force from the coupling mechanism on the image forming apparatus main assembly side, and transmits the received driving force to the conveying member 4, supplying thereby the toner receiving apparatus 7 with the toner from the toner supply container 1. Further, when the toner receiving opening 7*b* is in connection with the opening 1*b*, the gap between the toner supply container 1 and the wall of the toner receiving apparatus 7 is filled with the sealing member 10, preventing thereby the toner from entering from the toner receiving opening 7*b* and/or opening 1*b* into this gap.

After the completion of the toner supplying process, the user is to grasp the handle 2 and rotate the toner supply container 1 in the clockwise direction (direction Y in FIG. 5(*c*)), as seen from the direction of the opening 1*c* as the toner inlet. During the initial stage of the rotation, the connective portion 8*a* of the apparatus shutter 8 remains connected to the connective portion 6 of the toner supply container 1, being therefore pulled upward by the connective portion 6. Therefore, the connective portion 8*a* rotates with the toner supply container 1.

As the toner supply container 1 is further rotated, the apparatus shutter 8 comes into contact with the stopper 7*c*, being thereby prevented from moving further with the toner supply container 1. As a result, the connective portion 6 is forced to disconnect from the connective portion 8*a* of the apparatus shutter 8.

As the toner supply container 1 is further rotated, the opening 1*b* and sealing member 10 is covered by the container shutter 3, the clockwise rotation of which is regulated by the toner receiving apparatus 7. Then, in the final stage of the clockwise rotation of the toner supply container 1, the positional relationship among the above described components of the toner supply container 1 and toner receiving apparatus 7 becomes as shown in FIG. 5(*a*).

Lastly, the user is to pull the toner supply container 1 out of the toner receiving apparatus 7 to complete the operational sequence for resealing the toner receiving opening 7*b* and the opening 1*b* as the toner outlet, and extracting the toner supply container 1 from the toner receiving apparatus 7.

Incidentally, in this embodiment, it is from the front side of the apparatus main assembly that the toner supply container 1 is mounted into the toner receiving apparatus 7. However, the direction from which the toner supply container 1 is mounted into the toner receiving apparatus 7 does not need to be limited to the front side of the apparatus main assembly. For example, the toner supply container 1 and apparatus main assembly may be structured so that the toner supply container 1 is mounted into, or dismounted from, the toner receiving apparatus 7, on the top side of the apparatus main assembly.

Also in this embodiment, the toner supply container 1 and apparatus main assembly are structured so that when the opening 1*b* is facing in the horizontal direction, it is in connection with the toner receiving opening 7*b* of the wall of the toner receiving apparatus 7, the angular position of which relative to the vertical direction is roughly 90°. However, they do not need to be structured as they are in this embodiment.

Further, the direction in which the toner supply container 1 is rotated when it is set in the toner receiving apparatus 7 does not need to be limited to the above mentioned direction. For example, the toner supply container 1 and apparatus main assembly may be structured so that the opening 1*b* faces downward when the toner supply container 1 is mounted into the toner receiving apparatus 7, and the toner supply container 1 is rotated in the opposite direction from the direction in which the toner supply container 1 is rotated in this embodiment, for the purpose of unsealing; and is rotated in the direction opposite from that of the embodiment for the purpose of resealing.

When the above described structural arrangement was employed, toner did not leak from the opening 1*b* during the distribution of the toner supply container 1, or in the like situation. Further, after the sequence of setting the toner supply container 1 in the toner receiving apparatus 7 and taking it out of the toner receiving apparatus 7 is carried out one time, there was virtually no confirmable contamination of the toner supply container 1 and toner receiving apparatus 7 by toner. This was true even after the same sequence was repeated twenty times.

As was evident from the description of this embodiment given above, the structural arrangement in this embodiment can prevent the contamination attributable toner during the distribution of the toner supply container 1, as well as while the toner receiving apparatus 7 is supplied with toner by the toner supply container 1. In other words, it can prevent a user from being contaminated by the toner which has adhered to the toner supply container 1.

Incidentally, in the embodiment described above, the sealing member 10 is attached to the container proper 1*a* of the toner supply container 1. However, the sealing member 10 may be attached to the container shutter side. In such a case, the sealing film 9 is attached to the container proper 1*a*, without covering the sealing member 10 as it does in this embodiment.

Embodiment 2

Next, referring to FIG. 6, the toner supply container in this embodiment will be described. Incidentally, the toner supply container in this embodiment is the same in structure as that in the above described first embodiment, except for the part of the toner supply container, which will be described later. Further, the components, parts, etc., of the toner supply container in this embodiment, which are the same in function as those in the first embodiment are given the same referential numerals as those given to describe the first embodiment, and will not be described in detail.

This preferred embodiment is different from the first preferred embodiment in that the structure, in this embodiment, for exposing or covering the opening 1*b* is different from that in the first embodiment. More concretely, referring to FIG. 6(*a*), the toner supply container in this embodiment has a double cylinder structure: it has an internal cylinder 300, as a storage portion, in which toner is stored, and an external cylinder 400 (which hereafter may be referred to as shutter), which is rotatably fitted around the internal cylinder 300.

Figure 6:
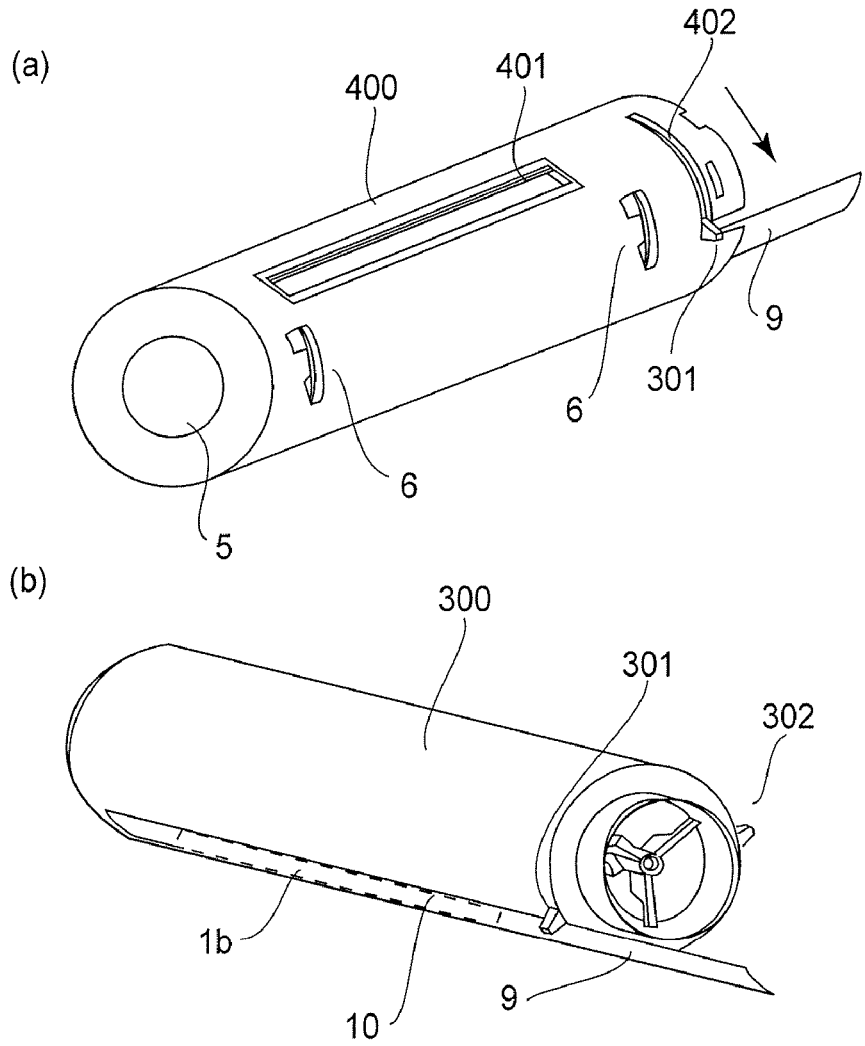
FIG. 6 illustrates a toner supply container according to another embodiment of the present invention, wherein (a) is a perspective view of the toner supply container, and (b) is a perspective view of an internal cylinder.

Referring to FIG. 6(*b*), this internal cylinder 300 is provided with an opening 1*b*, which is similar to that in the first embodiment. The internal cylinder 300 is also provided with a sealing member 10, which is attached to the internal cylinder 300 in a manner to surround the opening 1*b* as it is in the first embodiment. Further, the internal cylinder 300 is provided with a sealing film 9, which is attached to the internal cylinder 300 in a manner to cover the sealing member 10 as it does in the first embodiment.

In addition, the internal cylinder 300 is provided with a connective portion 302, which engages with the connective portion of the toner receiving apparatus to prevent the internal cylinder 300 from rotating further after the engagement of the connective portion 302 and the connective portion of the toner receiving apparatus. The peripheral surface of the internal cylinder 300 is provided with a guide projection 301.

As for the external cylinder 400, it is provided with a connective opening 401, which is connectible to the opening 1*b*. Further, the cylindrical wall of the external cylinder 400 is provided with a guide slot 402, in which the guide projection 301 of the internal cylinder 300 fits to be guided by the guide slot 402, preventing thereby the two cylinders 300 and 400 from becoming misaligned, in terms of the direction parallel to their rotational axes, when the external cylinder 400 rotates relative to the internal cylinder 300.

As the toner supply container structured as described above is mounted into the toner receiving apparatus, it becomes possible for the connective portion 302 of the internal cylinder 300 to engage with the connective portion of the toner receiving apparatus. Immediately after the mounting of the toner supply container into the toner receiving apparatus, the opening 1*b* of the internal cylinder 300 is roughly 90° apart from the connective opening 401 of the external cylinder 400 in terms of the circumferential direction of the toner supply container, and the sealing film 9 is to be peeled at this point in time by an operator.

Thereafter, the operator is to rotate the external cylinder 400 by a preset angle (which in this embodiment is roughly 90°) in the setup direction indicated by an arrow mark, relative to the internal cylinder 300 which is nonrotatably held by the toner receiving apparatus. Thus, as the external cylinder 400 is rotated, the opening 1*b* of the internal cylinder 300 becomes aligned with the connective opening 401 of the external cylinder 400, that is, the opening of the external cylinder 400 and the opening of the internal cylinder 300 become connected, making it possible for the toner receiving apparatus to be supplied with the toner from the toner supply container.

As for the sequence for taking the toner supply container out of the toner receiving apparatus, the toner supply container can be taken out of the toner receiving apparatus by carrying out in reverse the above described sequence for mounting the toner supply container into the toner receiving apparatus. That is, the operator is to rotates the external cylinder 400 in the direction opposite to the setup direction by a preset angle (which in this embodiment is roughly 90°) to cover the opening 1*b* of the internal cylinder 300. As the opening 1*b* is covered, it becomes possible for the operator to take the toner supply container out of the toner receiving apparatus.

As described above, in this embodiment, the role which the container shutter plays in the first embodiment is assumed by the external cylinder 400. Moreover, the container shutter is opened by the rotation of the external cylinder 400, instead of the rotation of the internal cylinder 300 as the toner storage portion.

The same effects as those obtained by the structural arrangement in the first preferred embodiment can also be obtained by the structural arrangement in this embodiment.

Incidentally, in this embodiment, the sealing member 10 is attached to the internal cylinder. However, the sealing member 10 may be attached to the internal surface of the external cylinder. In such a case, the sealing member 10 is attached to the internal surface of the external cylinder in a manner to surround the connective opening. This structural arrangement also can prevent the toner from leaking into the space between the internal and external cylinders, like the structural arrangement in this embodiment. Also in such a case, the sealing member 10 may be attached to the area of the internal surface of the external cylinder, which surrounds the opening 1*b* of the internal cylinder when the opening 1*b* is covered with the external cylinder, that is, during the distribution of the toner supply container.

Further, in the first and second preferred embodiments described above, the container proper of the developer supply container was roughly cylindrical. However, these embodiments are not intended to limit the scope of the present invention. That is, the shape of the developer supply container may be different from the one in the preceding two embodiments, as long as the shape allows the developer supply container to store developer. For example, it may be polygonal in cross section.

Also in the first and second preferred embodiments described above, the image forming apparatus (developer receiving apparatus) in accordance with the present invention was a copying machine. However, the present invention is also applicable to an image forming apparatus other than the copying machine. That is, it is also applicable to a printer, a facsimile machine, a multifunction apparatus having two or more functions of the preceding apparatuses, etc.

Further, in the first and second preferred embodiments described above, the image forming apparatus in accordance with the present invention was an image forming apparatus (developer receiving apparatus) which forms a monochromatic image (black-and-white image). However, the image forming apparatus to which the present invention is applied is not limited to an image forming apparatus such as the above described one.

For example, the image forming apparatus to which the present invention is applied may be a color image forming apparatus, which transfers in layers multiple toner images, different in color, onto the recording medium borne on the recording bearing member, from the photosensitive member, or a color image forming apparatus, which sequentially transfers in layers multiple developer images, different in color, onto the intermediary transfer member, from the photosensitive member, and transfers all at once the developer images on the intermediary transfer member, onto the recording medium.

In other words, a developer supply container in accordance with the present invention can be employable by the various image forming apparatuses described above.

Further, a developer supply container in accordance with the present invention may be structured so that it can supply developer to a process cartridge, as a developer receiving apparatus, which can be removably mountable in the main assembly of an image forming apparatus. That is, a developer supply container in accordance with the present invention may be structured so that it can be removably mounted into a process cartridge.

Incidentally, a process cartridge, such as the one described above, may be provided with at least the developing device 201*a*. Further, it may be provided with the electrophotographic photosensitive member 104, as an image bearing member, in addition to the developing device 201*a*. Moreover, it may be provided with at least one of the charging device 203 and cleaner 203 which are integrally disposed in the process cartridge to process the photosensitive drum 104.

In the preceding portion of this specification, the present invention has been described with reference to the preferred embodiments of the present invention. It is needless to say, however, that the various structures in the preceding preferred embodiments are modifiable to render them compatible with the well-known structures, within the scope of the present invention.

Next, comparative embodiments of the present invention will be described.

Comparative Embodiment 1

In this comparative embodiment, the toner supply container is not provided with the sealing film 9. Otherwise, the toner supply container is the same in structure as those in the preceding preferred embodiments.

In the case of the toner supply container in this comparative embodiment, toner leaked from the opening 1*b* and contaminated the toner supply container 1, during the distribution of the toner supply container. Therefore, carrying out the sequence for setting up the toner supply container 1 and taking the toner supply container 1 once was enough to badly contaminate the toner receiving apparatus 7.

The results of the above described testing of the structural arrangement in this comparative embodiment confirmed the effectiveness of the toner supply container structures in the preferred embodiments.

Comparative Embodiment 2

In this comparative embodiment, the toner receiving apparatus 7 is provided with the sealing member 10. Otherwise, the structural arrangement in this comparative embodiment is the same as those in the preceding preferred embodiments.

After the operation for setting up the toner supply container 1 in the toner receiving apparatus and removing the toner supply container 1 from the toner receiving apparatus is carried out only once, there was virtually no difference between this comparative embodiment and the preceding preferred embodiments, in terms of the level of contamination caused to the toner supply container 1 and/or toner receiving apparatus 7 by toner was. However, as the same operation was repeated twenty times, the toner having accumulated on the sealing member 10 transferred onto the toner supply container 1, worsening the contamination of the toner supply container 1 attributable to toner.

The results of the above described testing of the structural arrangement in this comparative embodiment confirmed the effectiveness of the structural arrangements in the preferred embodiments of the present invention.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 323691/2005 filed Nov. 8, 2005 which is hereby incorporated by reference.

What is claimed is:

1. A developer supply container detachably mountable to a developer receiving apparatus, said developer supply container comprising:

a container body having an inner space configured and positioned to contain a developer and a discharge opening configured and positioned to permit discharge of the developer;

an elastic member, fixedly mounted on said container body so as to surround said discharge opening, configured to substantially seal between said developer supply container and said developer receiving apparatus when the developer is discharged; and a removable film member, mounted on said container body at an area surrounding said discharge opening outside said elastic member, configured to prevent leakage of the developer from said container body through said discharge opening.

2. A developer supply container according to claim 1, wherein said film member is hot-welded to said container body outside of an area where said elastic member is mounted.

3. A developer supply container according to claim 1, wherein said film member is folded back toward a direction in which said film member is pulled by an operator.

4. A developer supply container according to claim 3, wherein said film member is configured to be entirely removed.

5. A developer supply container according to claim 3, wherein said film member is configured to be partly removed.

6. A developer supply container detachably mountable to a developer receiving apparatus, said developer supply container comprising:

a container body having an inner space configured to contain a developer and a discharge opening configured and positioned to permit discharge of the developer;

an elastic member, fixedly mounted on said container body so as to surround said discharge opening, configured to substantially seal between said developer supply container and said developer receiving apparatus when the developer is discharged;

a removable film member, mounted on said containing body at an area surrounding said discharge opening outside said elastic member, configured to prevent leakage of the developer from said container body through said discharge opening; and a shutter member, disposed so as to compress said elastic member between said shutter member and said container body, configured to open and close said discharge opening, said shutter member being slidable on said elastic member after said discharge opening is unsealed by removing said film member.

7. A developer supply container according to claim 6, wherein said film member is hot-welded to said container body outside of an area where said elastic member is mounted.

8. A developer supply container according to claim 7, wherein said film member is configured to be entirely removed.

9. A developer supply container according to claim 7, wherein said film member is configured to be partly removed.

10. A developer supply container according to claim 6, wherein said film member is folded back toward a direction in which said film member is pulled by an operator.

* * * * *